United States Patent [19]

Silvey

[11] 4,103,455

[45] Aug. 1, 1978

[54] TOY CHEST

[76] Inventor: Robert L. Silvey, 589 Woodland Hills Dr., Athens, Ga. 30601

[21] Appl. No.: 778,482

[22] Filed: Mar. 17, 1977

[51] Int. Cl.[2] ..... A63H 5/00

[52] U.S. Cl. ..... 46/99; 46/112; 46/118; 46/175 R

[58] Field of Search ..... 46/175 R, 116, 169 R, 46/232, 11, 103, 98, 99, 106, 112, 202, 118, 3, 4; 312/212; 232/43.1, 43.2

[56] References Cited

U.S. PATENT DOCUMENTS

| | | | |
|---|---|---|---|
| 2,546,297 | 3/1951 | Brice | 46/98 |
| 2,550,407 | 4/1951 | Dorshaw | 46/116 |
| 2,598,807 | 6/1952 | Lawson, Jr. et al. | 46/3 |
| 3,197,918 | 8/1965 | Coggeshall | 46/103 |
| 3,212,212 | 10/1965 | Miller | 46/221 X |

*Primary Examiner*—Louis G. Mancene
*Assistant Examiner*—Mickey Yu
*Attorney, Agent, or Firm*—Newton, Hopkins & Ormsby

[57] ABSTRACT

A toy chest of animal form mounted on casters for easy mobility has a hinged lid which may be opened for access to a toy storage compartment in the body portion of the chest. A manually operated pocketed delivery cylinder on the lid enables a child to deliver toys into the storage compartment and in so doing the delivery cylinder drives associated mechanism to actuate a sounding device housed within the lid and simultaneously causes movement of simulated animal eyes. The audible and visual reward for the child during activation of the delivery cylinder provides an incentive for the child to clean up his or her room.

12 Claims, 3 Drawing Figures

TOY CHEST

BACKGROUND OF THE INVENTION

Toy storage boxes or chests are known in the prior art as well as certain other types of containers and devices which produce music or other sound or exhibit some sort of visual display when operated. Some examples of the patented prior art are shown in U.S. Pat. Nos. 2,484,896; 2,657,607; 2,933,853; 3,059,608 and 3,239,229.

In general, the object of the present invention is to improve on the prior art by providing a unique and entertaining toy box or chest which will promote neatness in children by rewarding them through audible and visual means on the toy chest whenever the child picks up a toy from the floor or from furniture and introduces it into the storage compartment of the chest. More particularly, the child is encouraged to clean up his or her room following a play period and return scattered toys to the toy chest. In so doing, the child will crank a pocketed storage delivery cylinder or rotor near the top of the chest and deposit toys into a chute leading to the toy storage compartment. In cranking the delivery cylinder, an associated mechanism will cause a noisemaker in the lid portion of the toy chest, such as a small drum, to be activated and simultaneously simulated animal eyes on the lid portion of the chest are moved in a lifelike manner. The driving mechanism for these elements is very simple and sturdy and this constitutes another feature of the invention. A transparent window in the lid portion of the chest allows the child to view the drum as it is being played. The child can easily raise the lid of the chest for open access to the toy storage compartment.

DETAILED DESCRIPTION

Figure 1:
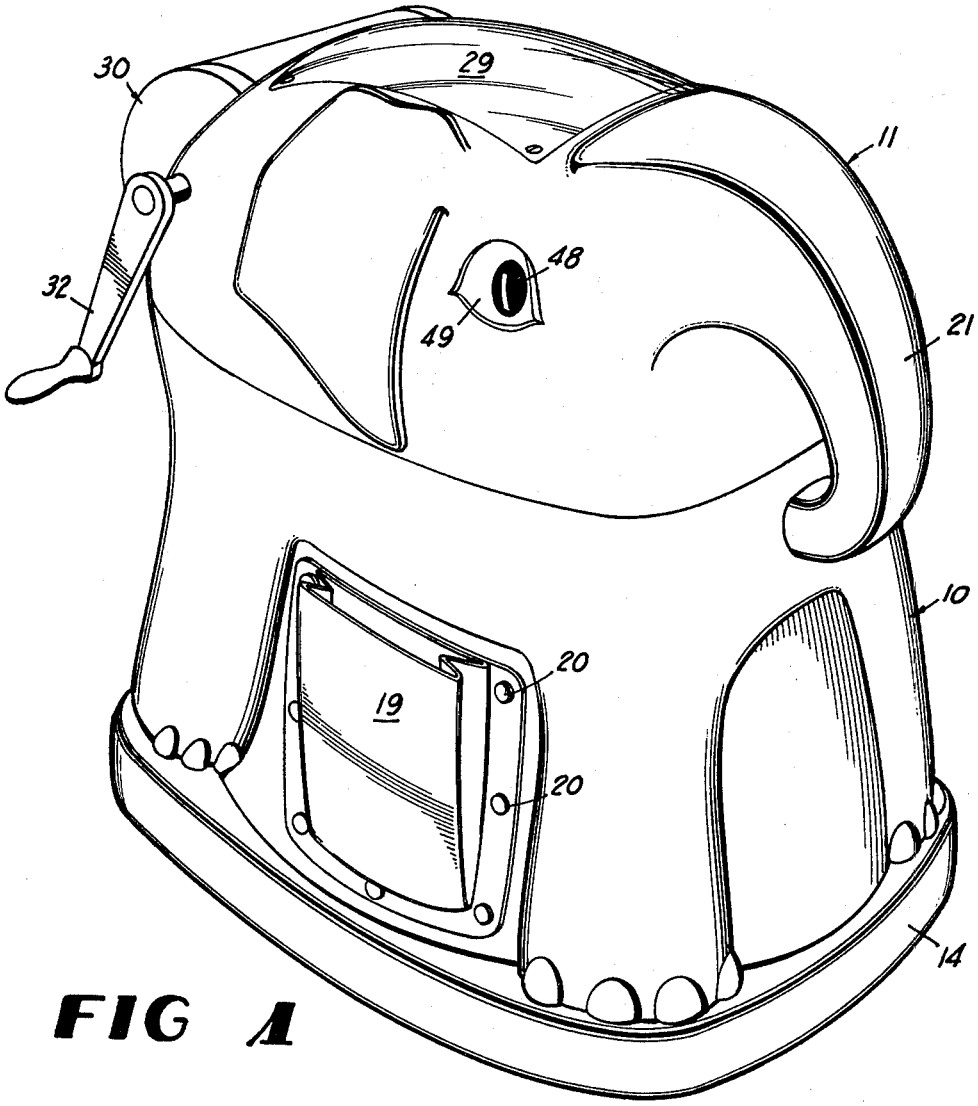
FIG. 1 is a perspective view of a child's toy chest embodying the invention.
Figure 2:
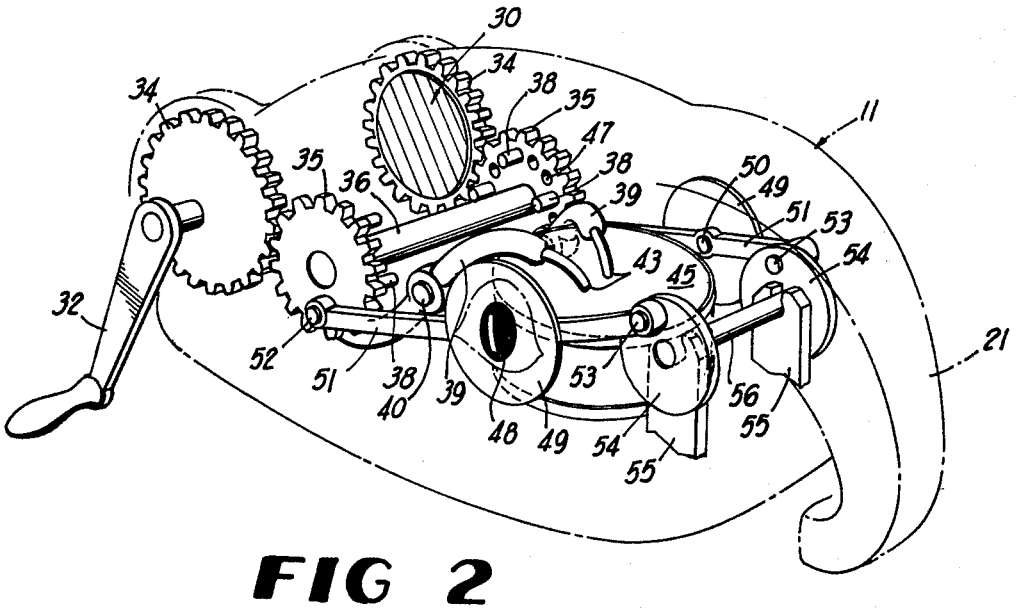
FIG. 2 is a perspective view, partly in cross section, of mechanism container in the hinged lid of the toy chest.

Referring to the drawings in detail wherein like numerals designate like parts, a toy chest embodying the present invention comprises a base or body portion 10 and a lid portion 11 hinged to the base portion 10 by a horizontal transverse axis hinge pin 12. Both the base and lid sections 10 and 11 are preferably formed of molded high impact plastics material and both sections are shaped so that the chest, when the lid is closed, will depict an animal figure such as an elephant, as shown clearly in FIG. 1. Other animal forms may be embodied in the toy chest within the scope of the invention.

For convenience and mobility, the base section 10 is mounted on casters 13, and preferably the bottom of the base section carries a marginal rubber-like bumper 14 to prevent damaging furniture.

The base section 10 has a large central open top storage compartment 15 extending for substantially the full height of the base section and for substantial distances fore and aft and across the base section so that the largest possible toy storage capacity can be achieved. For further convenience, a flexible removable toy storage pouch 16 preferably of plastics material is suspended in the compartment 15 by separable snap fasteners 17 near the top of the pouch. If desired, the bottom wall 18 of the storage compartment 15 may be internally padded with a layer of foam material or the like.

For added convenience, the base section 10 may include one or more exterior storage pockets 19 on its sides or ends adapted to hold books, crayons and other small articles. The pocket or pockets 19 are preferably attached to the base section 10 by snap fasteners 20.

The lid section 11, which in the present embodiment simulates an elephant's head, includes a snout or trunk 21 serving as a handle by means of which the lid of the chest can be raised and lowered on the axis of the hinge pin 12. A permanent magnet 22 contained within a recess at the bottom of the handle 21 is attracted by a paramagnetic plate 23 on the base section 10 and fixed thereon when the lid is closed. The arrangement forms a convenient and easily releasable means to retain the lid portion 11 of the chest closed.

It can be seen that when the lid portion 11 is swung upwardly and rearwardly by the child, the entire open top of the pouch 16 is exposed and the child has ready access to the toys therein. A horizontal manipulating handle 24 on the rear of the hinged lid section 18 allows the chest to be steered by the child and also serves to limit the opening swing of the lid section 11 when the handle 24 engages the rear wall of the base section 10.

The lid section 11 has a hollow forward chamber 25 for mechanism to be described and defined by a horizontal bottom wall 26 on the lid section and a rearward inclined wall 27 rising from the wall 26 and forming a passageway 28 for toys or other objects to enter the storage pouch 16 by the operation of means to be described. The lid section 11 also has a transparent window panel 29 in its top wall through which a child can view the operation of sounding means and mechanism housed safely in the chamber 25 and away from the hands and fingers of the child.

Figure 3:
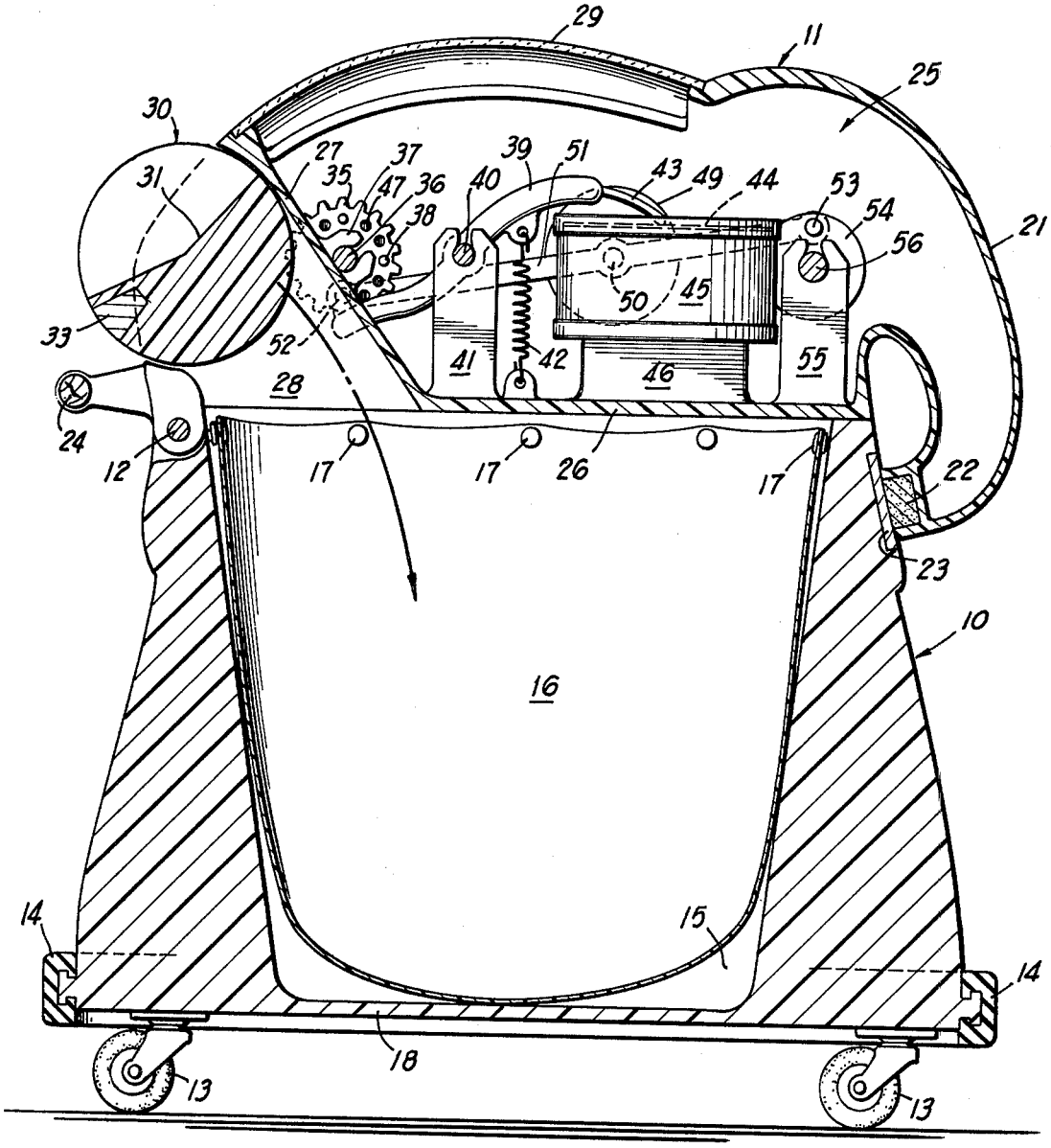
FIG. 3 is a central vertical cross section taken through the toy chest with the hinged lid in the closed position.

A horizontal transverse axis delivery rotor 30 on the rear of the lid section 11 has a pocket 31 formed in its periphery of sufficient size to contain a toy or several small toys which a child may want to introduce into the storage pouch 16 without opening the entire lid section 11. The cylindrical rotor 30 is suitably journaled on the rear of the lid section 11 within the mouth of the passage 28 and is equipped with a manual turning crank 32 and may also carry a counterweight 33, FIG. 3, urging the rotor 30 toward its passage closing position illustrated in the drawings.

At its opposite ends, the toy delivery rotor 31 carries spur gears 34 which mesh with somewhat smaller gears 35 on a cross shaft 36 within the chamber 25. The shaft 36 is held in a simple bearing structure 37 formed integrally with the inclined wall 27.

Circumferentially spaced pegs 38 on the two gears 35 project inwardly thereof to operate a pair of drum playing levers 39 which are rockably supported as at 40 on bearing posts 41 rising from the wall 26 and fixed thereto. The levers 39 extend fore and aft of the posts 41 and the forward portions of these levers are biased downwardly by spring means 42. At their forward ends, the levers 39 carry drum sticks 43 which act against the horizontal head or skin 44 of a drum 45 supported horizontally in the chamber 25 on a pedestal 46 rising from the wall 26.

The rearward extremities of levers 39 lie between the gears 35 and close to their inner sides, whereby the pegs 38 rotating with the gears 35 trip the levers 39 and cause them to pivot at 40 and under the force of spring means 42 to play a tune on the drum 45 by means of the drum sticks 43. The gears 35 have multiple spaced openings 47 within which the pegs 38 can be selectively placed at different positions around the gears to vary the tune played by means of the drum. Consequently, when a child places a toy in the pouch 16 by use of the rotor 30, the resulting rotation of the gears 35 and associated mechanism including the drum sticks 43 will play the drum, thus rewarding the child for cleaning his or her room.

Simultaneously, the rotation of the rotor 30 by its hand crank 32 will produce a life-like rolling movement of simulated eyes 48 painted on discs 49 arranged adjacent to eye openings in the head portion of the simulated animal lid section 11.

More particularly, the discs 49 are secured as at 50 to links 51 which have their rear ends connected by eccentrics 52 with the outer sides of gears 35. The forward ends of the links 51 are similarly connected by eccentrics 53 with idler discs 54 which are rotatably supported on bearing supports 55 rising from the horizontal wall 26, the idler discs 54 being carried by a transverse shaft 56 journaled on the supports 55. As shown, the links 51 extend forwardly and rearwardly of the elements 49 and 50 and due to their eccentric mountings at 52 and 53, when the gears 35 are turned, the simulated eyes 48 will oscillate or roll with a realistic and life-like motion which will be entertaining to children. It should be clear that turning the hand crank 32 and rotor 30 will simultaneously activate both the drum 45 and the discs 49 carrying eyes 48 so that the child receives both an audible and visual reward for placing toys in the chest by means of the rotor 30 which delivers the toys through the passageway 28 as shown by the directional arrow in FIG. 3.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A toy chest comprising a base section having an open top storage compartment and a hinged lid section, said lid section having a passage leading into said storage compartment when the lid section is in a closed position, a manually movable toy delivery member on the lid section operable to deliver toys through said passage to said storage compartment, and audio-visual means on said lid section operated by movement of said toy delivery member to reward a child for placing a toy in the toy chest by use of the toy delivery member.

2. A toy chest as defined in claim 1, and said toy delivery member comprising a pocketed rotor having a hand crank and being journaled in the mouth of said passage.

3. A toy chest as defined in claim 2, and said audio-visual means on said lid section comprising a noise maker and a movable visual display element, and mechanism on said lid section operatively connected with said rotor and with the noise maker and visual display element.

4. A toy chest as defined in claim 3, and said mechanism comprising gear means on said rotor, coacting gear means on the lid section in mesh with the gear means of the rotor, pivoted members on the lid section driven by said coacting gear means and operating said noise maker, and eccentric linkage means interconnecting said coacting gear means and said visual display element and driving the latter.

5. A toy chest as defined in claim 4, and said noise maker comprising a drum, said pivoted members comprising drum sticks, and said visual display element comprising at least one simulated animal eye.

6. A toy chest as defined in claim 5, and spring means biasing said drum sticks toward contact with said drum, and spaced pegs on said coacting gear means and engaging said drum sticks during rotation of the coacting gear means and tripping over corresponding ends of the drum sticks on the opposite sides of the drum stick pivots from said spring means.

7. A toy chest as defined in claim 6, and said coacting gear means having plural circumferentially spaced peg openings whereby pegs can be selectively positioned on the coacting gear means to vary music played by said drum.

8. A toy chest as defined in claim 1, wherein said base section and hinged lid section together are shaped to simulate an animal form.

9. A toy chest as defined in claim 1, and a pouch for toys removably mounted in said storage compartment of the base section.

10. A toy chest as defined in claim 1, and casters on the bottom of said base section of the toy chest.

11. A toy chest as defined in claim 1, and a transparent viewing window in the top of said lid section adjacent to said audio-visual means.

12. A toy chest as defined in claim 11, and said hinged lid section including a substantially closed chamber for said audio-visual means ahead of said manually movable toy delivery member, and operating means for said audio-visual means in said chamber including a connection with said movable toy delivery member.

* * * * *